US009945134B2

(12) United States Patent
Go et al.

(10) Patent No.: US 9,945,134 B2
(45) Date of Patent: Apr. 17, 2018

(54) LOAD-ADJUSTABLE VERTICALLY MOVING SCAFFOLD

(71) Applicant: Byeong Ki Go, Gwangju (KR)

(72) Inventors: Byeong Ki Go, Gwangju (KR); Jeon Sun Im, Gwangju (KR); Seong Hyeon Go, Gwangju (KR); Se Hyeon Go, Gwangju (KR); Dae Hyeon Go, Gwangju (KR)

(73) Assignee: Byeong Ki Go, Gwangju (KR)

( * ) Notice: Subject to any disclaimer, the term of this patent is extended or adjusted under 35 U.S.C. 154(b) by 0 days.

(21) Appl. No.: 15/221,535

(22) Filed: Jul. 27, 2016

(65) Prior Publication Data

US 2017/0030093 A1 Feb. 2, 2017

(30) Foreign Application Priority Data

Jul. 28, 2015 (KR) ..... 10-2015-0106323
Sep. 22, 2015 (KR) ..... 10-2015-0133930

(51) Int. Cl.
*E04G 1/18* (2006.01)
*E04G 1/20* (2006.01)
*E04G 21/24* (2006.01)

(52) U.S. Cl.
CPC ..... *E04G 1/20* (2013.01); *E04G 21/24* (2013.01)

(58) Field of Classification Search
CPC ... E04G 1/20; E04G 1/22; B66F 11/00; B66F 11/04; B66F 11/042
See application file for complete search history.

(56) References Cited

U.S. PATENT DOCUMENTS 979,220 A * 12/1910 Taber ..... E04G 1/22 182/101
1,202,571 A * 10/1916 Olsen ..... E04G 1/22 182/141
4,157,743 A * 6/1979 Masuda ..... B66F 11/042 182/141
4,427,094 A * 1/1984 Winkelblech ..... B66F 11/04 182/148
5,365,860 A * 11/1994 Billington, III ..... A47C 9/025 108/108
5,402,737 A * 4/1995 Kanazawa ..... A47B 9/16 108/147
7,070,167 B1 * 7/2006 Bacon ..... B66F 7/0625 254/10 C
9,212,038 B1 * 12/2015 Presti ..... B66F 11/042
(Continued)

*Primary Examiner* — Jerry E Redman
(74) *Attorney, Agent, or Firm* — Hauptman Ham, LLP

(57) ABSTRACT

A load-adjustable vertically moving scaffold comprises a base unit, a work support provided on an upper part of the base unit and a lift supporting unit supporting the work support to vertically move with respect to the base unit, and the lift supporting unit comprises fixed guide members extended upward from both sides of the base unit, slope guide members installed at front sides of the fixed guide members and configured to be tilted with respect to the fixed guide members, a lift supporting shaft configured to vertically move along the slope guide members, and an elastic member having one end fixed to one side of the work support adjacent to the fixed guide members and other end connected with the lift supporting shaft to apply an elastic bias to the lift supporting shaft toward the fixed guide members.

10 Claims, 15 Drawing Sheets

(56) References Cited

U.S. PATENT DOCUMENTS

| | | | | |
|---|---|---|---|---|
| 2015/0008072 | A1* | 1/2015 | Knox | E04G 1/22<br>182/141 |
| 2017/0120792 | A1* | 5/2017 | Riggs | B66F 3/24 |
| 2017/0137270 | A1* | 5/2017 | Shugen | B66F 11/04 |
| 2017/0137271 | A1* | 5/2017 | Shugen | B66F 11/04 |

* cited by examiner

LOAD-ADJUSTABLE VERTICALLY MOVING SCAFFOLD

CROSS-REFERENCE TO RELATED APPLICATION

This application claims priority to and the benefit of Korean Patent Application No. 10-2015-0106323, filed on Jul. 28, 2015 and Korean Patent Application No. 10-2015-0133930, filed on Sep. 22, 2015, the disclosure of which is incorporated herein by reference in its entirety.

BACKGROUND

1. Field of the Invention

The present invention relates to a load-adjustable vertically moving scaffold, and more specifically, to a load-adjustable vertically moving scaffold capable of allowing a worker to continue a work at a predetermined height by automatically lowering or lifting a work support when an object to be processed is loaded or unloaded, and adjusting a lowering distance per unit weight depending on kinds of objects to be loaded.

2. Discussion of Related Art

Generally, scaffolds allow various tools or materials required according to a work process to be placed thereon, and are classified into a fixed type in which a plate on which the tools or materials are placed is fixed and a lifting type in which the plate is vertically moved by a separate lifting means.

Of those, a vertically moving scaffold is capable of adjusting its height by lifting and lowering a plate as necessary, and has a link structure in which a plurality of horizontal link bars and vertical link bars are connected by various joints.

More specifically, a conventional vertically moving scaffold, as shown in FIG. 1, includes a base frame 11, a mount frame 13 including a plate on which tools, materials, etc. are placed, and a lifting link structure 15 for lifting the mount frame 13, and adjusts its height by vertically moving the mount frame 13 by vertical extension of the link structure 15.

Since the conventional vertically moving scaffold generally has a complicated structure due to the link structure 15 for lifting the mount frame 14, there have been problems of causes of malfunction and failure being provided and supporting a load and also precisely adjusting the height when a weight of the placed material is relatively great being difficult.

To solve these problems, various vertically moving scaffolds have been developed, however, the conventional vertically moving scaffold is capable of adjusting a lift height through a pump, an electric motor, or other actuators, and has a problem of work efficiency being degraded due to long time required to control a height of a scaffold when it is necessary to frequently change the height of the scaffold.

SUMMARY OF THE INVENTION

The present invention is directed to provide a load-adjustable vertically moving scaffold to solve the problems. The load-adjustable vertically moving scaffold has high work efficiency and is able to adjust a lowering distance per unit weight of objects to be processed by automatically lowering according to a load of the objects to be processed.

The load-adjustable vertically moving scaffold according to present invention may include a base unit, a work support provided on an upper part of the base unit and configured to support objects to be processed, and a lift supporting unit supporting the work support to vertically move with respect to the base unit, wherein the lift supporting unit may include fixed guide members extended upward from both sides of the base unit, slope guide members installed at front sides of the fixed guide members and formed to be tilted with respect to the fixed guide members in a direction away from the fixed guide members while being extended downward from an upper end thereof, a lift supporting shaft configured to vertically move along the slope guide members, and an elastic member having one end fixed to one side of the work support adjacent to the fixed guide members and the other end connected with the lift supporting shaft to apply an elastic bias to the lift supporting shaft toward the fixed guide members, wherein the work support is coupled so that the one side to which the elastic member is fixed is vertically moved along the fixed guide members and has a lower end of the other side formed to be supported on the lift supporting shaft.

The slope guide members may each be coupled to one side of each of the fixed guide members to be rotatable in forward and rearward directions of the base unit so that tilt angles are adjustable with respect to the fixed guide members, and may further include a tilt angle adjusting unit to control the tilt angles of the slope guide members.

The slope guide members may be extended in parallel to the fixed guide members to be lowered down to a lowermost position even if the objects to be processed are not loaded on the work support.

The tilt angle adjusting unit may preferably include a rotating shaft extended in a direction in which both slope guide members are connected to the base unit and rotatably installed thereto; pinions coupled to both ends of the rotating shaft and integrally rotating with the rotating shaft; racks formed on lower ends of the slope guide members, extended in a circular arc direction with respect to rotation centers of the slope guide members, and engaged with the pinions; and a control lever controlling the tilt angles of the slope guide members by rotating the slope guide members, which are connected through the racks, by rotating the pinions.

The load-adjustable vertically moving scaffold may further include a latching unit connecting the rotating shaft and the control lever so that the pinions are rotated in one direction by the rotation of the control lever in a process in which the tilt angles of the slope guide members are controlled by the control lever.

The tilt angle adjusting unit may include an actuator including a main body installed at the base unit and withdrawing rods connected with the slope guide members, and is configured to control the tilt angles of the slope guide members by forward and backward movement of the withdrawing rods.

The base unit may further include a transfer caster formed on a lower part thereof to be movable.

The work support may further include a lifting unit supported to be lifted with respect to the base unit by the lift supporting unit; and a loading unit support which protrudes forward from the lifting unit to be lifted along with the lifting unit and is coupled to the loading unit, and may further include a cover unit configured to surround the base unit, the lift supporting unit, and the lifting unit and having a long hole vertically extended on one side thereof so that the loading unit support passes therethrough.

The loading unit may be configured to correspond to shapes or sizes of objects to be processed and configured to be coupled to and separated from the loading unit support.

The load-adjustable vertically moving scaffold according to the present invention can constantly maintain a work height of a worker by lowering and lifting a work support in a process in which the objects to be processed are loaded or unloaded, thereby preventing a waist or knee of the worker from being injured.

Further, the load-adjustable vertically moving scaffold can be applied to various products by controlling a lowering distance per unit weight according to kinds of the objects to be processed.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
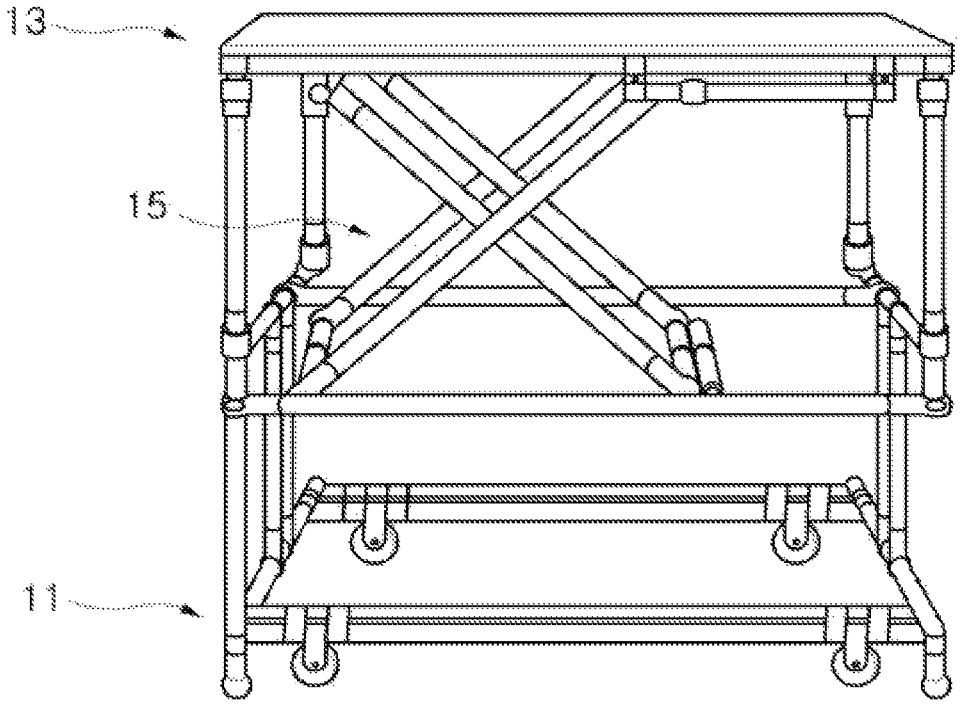
FIG. 1 (Related Art)
FIG. 1 is a view illustrating a conventional vertically moving scaffold.

Hereinafter, a load-adjustable vertically moving scaffold according to the embodiment of the present invention will be described in detail with reference to the attached drawings. While the invention is susceptible to various modifications and alternative forms, specific embodiments thereof are shown by way of example in the drawings and will herein be described in detail. It should be understood, however, that there is no intent to limit the invention to the particular forms disclosed, on the contrary, the invention is to cover all modifications, equivalents, and alternatives falling within the spirit and scope of the invention. In the attached drawings, the dimensions of components are shown in an enlarged scale for clarity of the present invention.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the present invention.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprise," "comprising," "include" and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In FIGS. 2 to 6, an embodiment of a load-adjustable vertically moving scaffold 10 according to present invention is illustrated.

Referring to the figures, the load-adjustable vertically moving scaffold 10 includes a base unit 100, a work support 200 installed on an upper part of the base unit 100 to support objects to be processed, and a lift supporting unit 300 supporting the work support 200 to vertically move with respect to the base unit 100.

The base unit 100 is installed on a floor of a work place to support the lift supporting unit 300 and the work support 200. As shown in the embodiment of the present invention, the base unit 100 may include a support member 110 to be simply supported on the floor of the workplace and to be fixed and installed to the floor of the work place through an anchor, a fixing bolt, or the like.

The work support 200 is installed on an upper part of the base unit 100 to be vertically moved by the lift supporting unit 300. The objects to be processed may be loaded or placed on the work support 200 for a work.

The work support 200 has a planar shape in the embodiment of the present invention, however, the work support 200 may be formed in various shapes according to the kinds or shapes of the objects to be processed, and may include escaping prevention members formed at an edge of the work support 200 to prevent the objects to be processed from escaping as necessary.

A rod cell is attached to the work support 200 to measure weights of the objects to be processed mounted on the work support 200 or prevent the objects to be processed, having weights greater than a set weight, from being loaded.

The lift supporting unit 300 supports the work support 200 to vertically move with respect to the base unit 100.

The lift supporting unit 300 includes fixed guide members 310 extended upward from both sides of the base unit 100, slope guide members 320 installed to be spaced apart from the fixed guide members 310 at a predetermined distance, a lift supporting shaft 330 vertically moving along with the slope guide members 320, and an elastic member 340 installed between the lift supporting shaft 330 and the work support 200.

Hereafter, for convenience, a portion to which the fixed guide members 310 are installed is referred to as a rear side of the base unit 100, and a direction in which the slope guide members 320 are installed with respect to the fixed guide members 310 is referred to as a front side.

The fixed guide members 310 are provided on both sides of a rear end of the base unit 100, respectively. The two fixed guide members 310 are extended upward from the base unit 100 in a vertical direction. First guide grooves 311 extended in a vertical longitudinal direction are formed on two opposite surfaces of the fixed guide members 310, respectively, and first guide rollers 210 installed on both sides of the rear side of the work support 200 are formed to move along the first guide grooves 311.

The two fixed guide members 310 are connected with each other by a connecting bar 350, wherein the connecting bar 350 prevents the fixed guide members 310 from moving away from each other in a process in which the work support 200 is lifted or lowered.

The slope guide members 320 are extended from front sides of the fixed guide members 310 to be tilt at a predetermined angle with respect to the fixed guide members 310. That is, the slope guide members 320 are formed to be tilted in a direction away from the fixed guide members 310 while extending downward from upper ends. One upper side of each of the slope guide members 320 is rotatably coupled to a connecting member formed in each of the fixed guide members 310, such that the slope guide members 320 may entirely be rotated at a predetermined angle with respect to coupling points P.

Second guide grooves 321 are also formed at opposite surfaces of the slope guide members 320 in a longitudinal direction, and the lift supporting shaft 330 is connected with the second guide grooves 321 to be lifted.

The lift supporting shaft 330 includes second guide rollers 331 formed on both sides thereof to move along the second guide grooves 321, so the lift supporting shaft 330 may vertically move along the slope guide members 320. The lift supporting shaft 330 supports a lower end of the work support 200.

The elastic member 340, which is an extension spring, has one end connected to a rear end of the work support 200 and the other end connected to the lift supporting shaft 330.

Further, a gas cylinder may be further provided at a lower part of the work support 200 to absorb shock. One side and the other side of the gas cylinder are each installed at the lift supporting shaft 330 and the front end of the work support 200 to prevent the work support 200 from being suddenly lowered or lifted due to sudden change in a load generated when the objects to be processed are suddenly loaded on or unloaded from the work support 200.

In the lift supporting unit 300, the slope guide members 320 are formed to be tilted in a direction away from the fixed guide members 310 while extending downward from the fixed guide members 310. Thus, when the objects to be processed are loaded on the work support 200, the work support 200 is lowered while the elastic member 340 is elongated by the load of the objects to be processed. The work support 200 is stopped at a point that the load of the objects to be processed on the work support 200 and an elastic force of the elastic member 340 are in equilibrium. When the objects to be processed are additionally loaded, the work support 200 is further lowered to correspond to an increased load. Conversely, when the objects to be processed loaded on the work support 200 are unloaded, the work support 200 is lifted by the elastic force of the elastic member 340 while the load is reduced.

Since the work support 200 is automatically lowered or lifted depending on whether the load, applied to the work support 200 while the objects to be processed are loaded on or unloaded from the work support 200, is changed, a worker continues to work at a predetermined height, thereby increasing work efficiency.

Also, the lift supporting unit 300 may further include a tilt angle adjusting unit 360 to control tilt angles of the slope guide members 320.

As the tilt angles of the slope guide members 320 are adjusted by the tilt angle adjusting unit 360, when the objects to be processed are loaded or unloaded, a lift distance per unit weight of the work support 200 may be adjusted. That is, when the slope guide members 320 have larger tilt angles than the fixed guide members 310, a lowering distance per unit weight of the work support 200 is reduced. Conversely, when the slope guide members 320 are moved in a direction approaching the fixed guide members 310, such that the tilt angles are reduced, the lowering distance per unit weight of the work support 200 is increased.

Therefore, when the objects to be processed are made of a material having a high specific gravity such as metal or stone, tilt angles of the slope guide members 320 are increased. When the objects to be processed are made of a material having a low specific gravity such as a synthetic resin, a fiber, or a paper box, the tilt angles of the slope guide members 320 are reduced. Thus, a lowering distance is controlled according to kinds of the objects to be processed.

The tilt angle adjusting unit 360 includes a rotating shaft installed at the base unit 100, pinions 362 installed at the rotating shaft, racks 363 coupled to lower ends of the slope guide members 320; a control lever 364 for rotating the rotating shaft; and a latch unit 365 connecting the control lever 364 with the rotating shaft.

The rotating shaft is installed at the base unit 100 to be extended in a direction of connecting the slope guide members 320, and is rotatable. The pinions 362 are installed on both ends of the rotating shaft to be integrally rotated along with the rotating shaft.

The racks 363, as described above, are formed at lower ends of the slope guide members 320, and are extended in a circular arc direction with respect to the coupling points P as rotation centers of the slope guide members 320. The racks 363 are engaged with the pinions 362, such that rotation force is transmitted by the pinions 362 and the racks 363. And thus, the slope guide members 320 may be rotated forward or backward with respect to the coupling points P.

The control lever 364 is to control tilt angles of the slope guide members 320 by rotating the rotating shaft, and is connected with the rotating shaft by the latch unit 365.

The latch unit 365 includes two latch wheels 366 installed on the rotating shaft, and a first latch 367 and a second latch 368 mounted to the latch wheels 366, respectively. The first latch 367 transmits the rotational force to the rotating shaft only when the control lever 364 is rotated on one side, and the second latch 368 is configured to limit rotation of the slope guide members 320.

When the slope guide members 320 are rotated in a direction in which the tilt angles are increased, fixing positions of the first latch 367 and the second latch 368 are set to rotate the first latch 367 and the second latch 368 in one direction of the rotating shaft, and the rotational force is transmitted so that the pinions 362 are rotated in a direction in which the slope guide members 320 are moved away from each other. Conversely, when the slope guide members 320 are rotated in a direction in which the tilt angles are decreased, the fixing positions of the first latch 367 and the second latch 368 are set to have the opposite effect to when the tilt angles are increased.

When the control of the slope guide members 320 is completed, the second latch 368 is fixed in the opposite direction to the first latch 367, such that the slope guide members 320 keep the tilt angles fixed regardless of external factors such as a load change of the objects to be processed.

Figure 2:
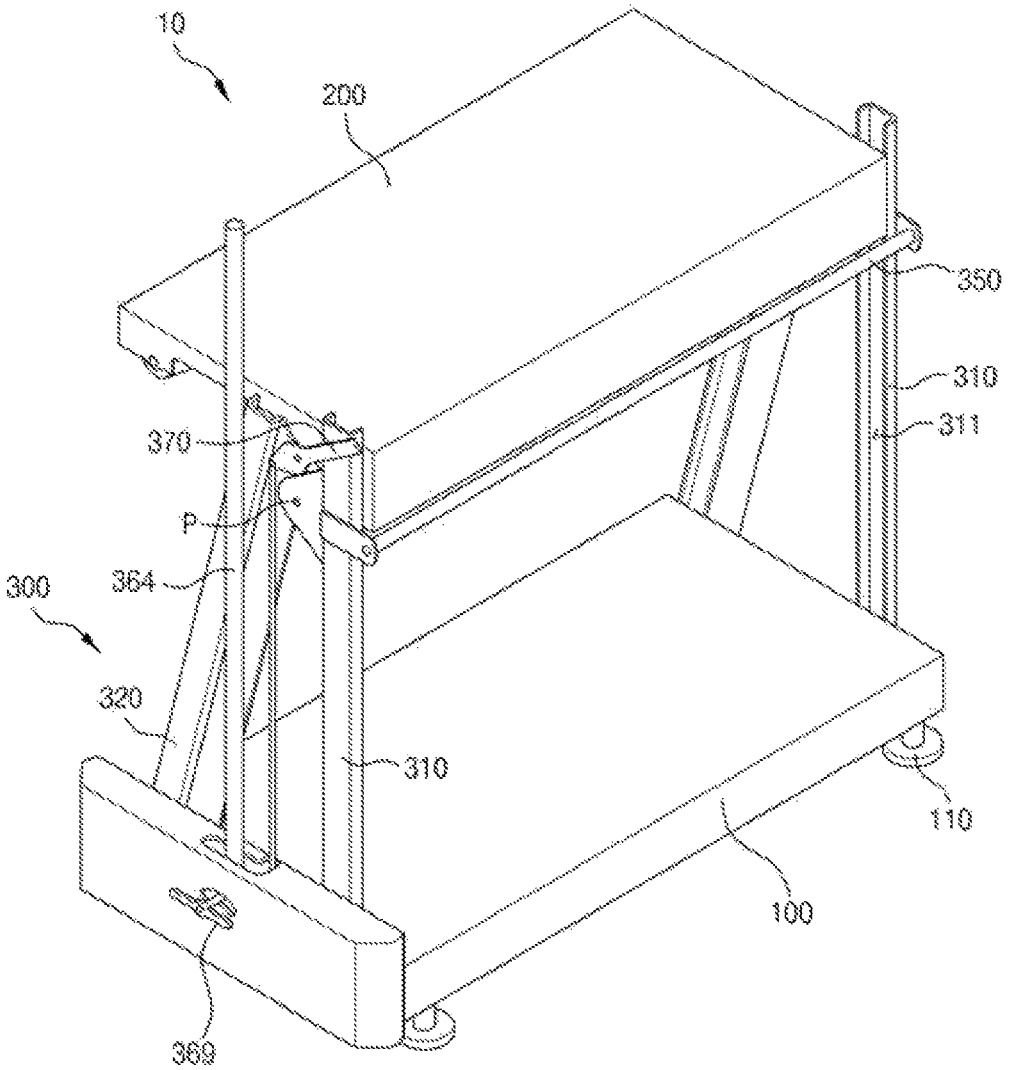
FIG. 2 is a perspective view illustrating an embodiment of a load-adjustable vertically moving scaffold according to the present invention.
Figure 3:
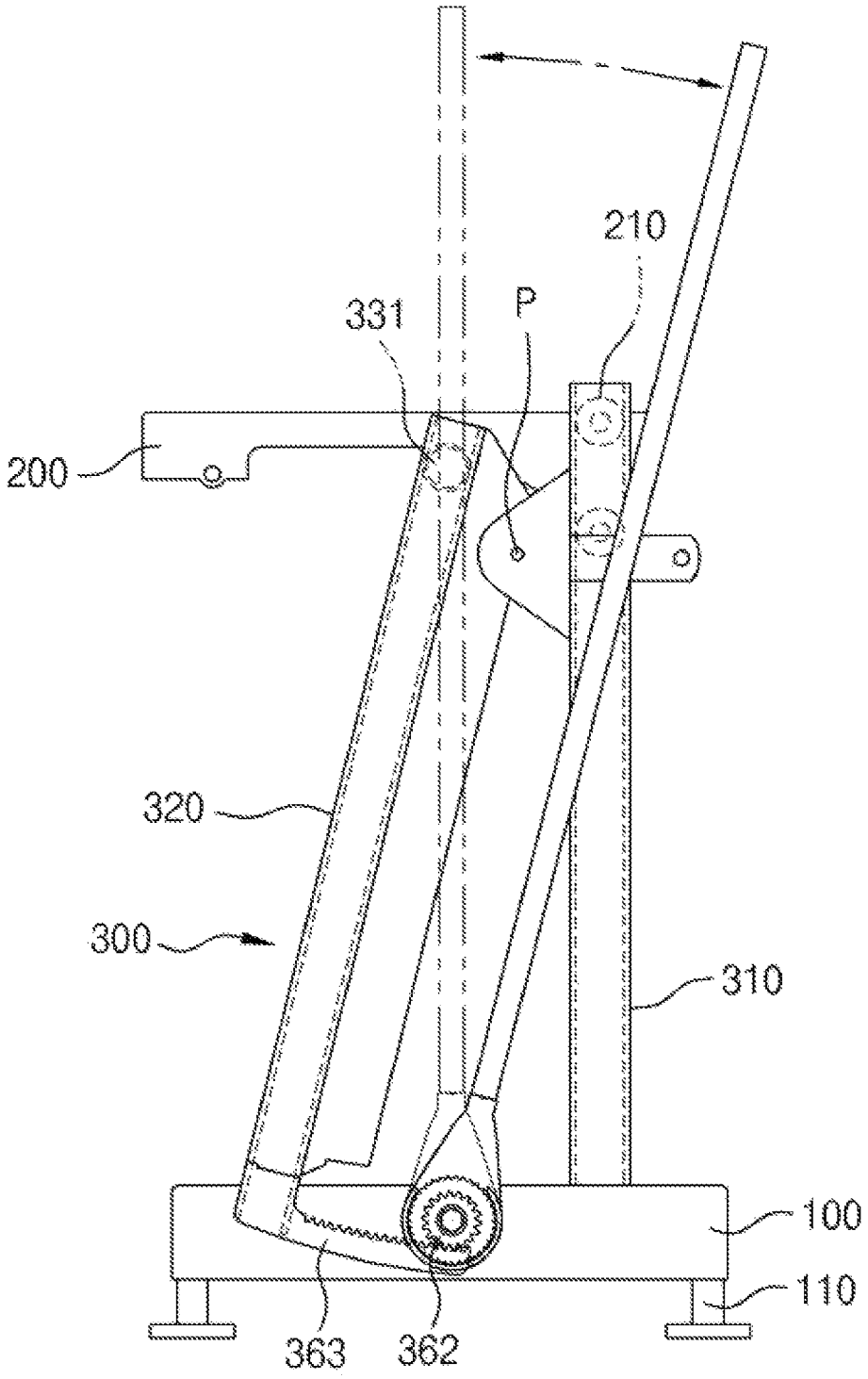
FIG. 3 is a front view of the load-adjustable vertically moving scaffold of FIG. 2.
Figure 4:
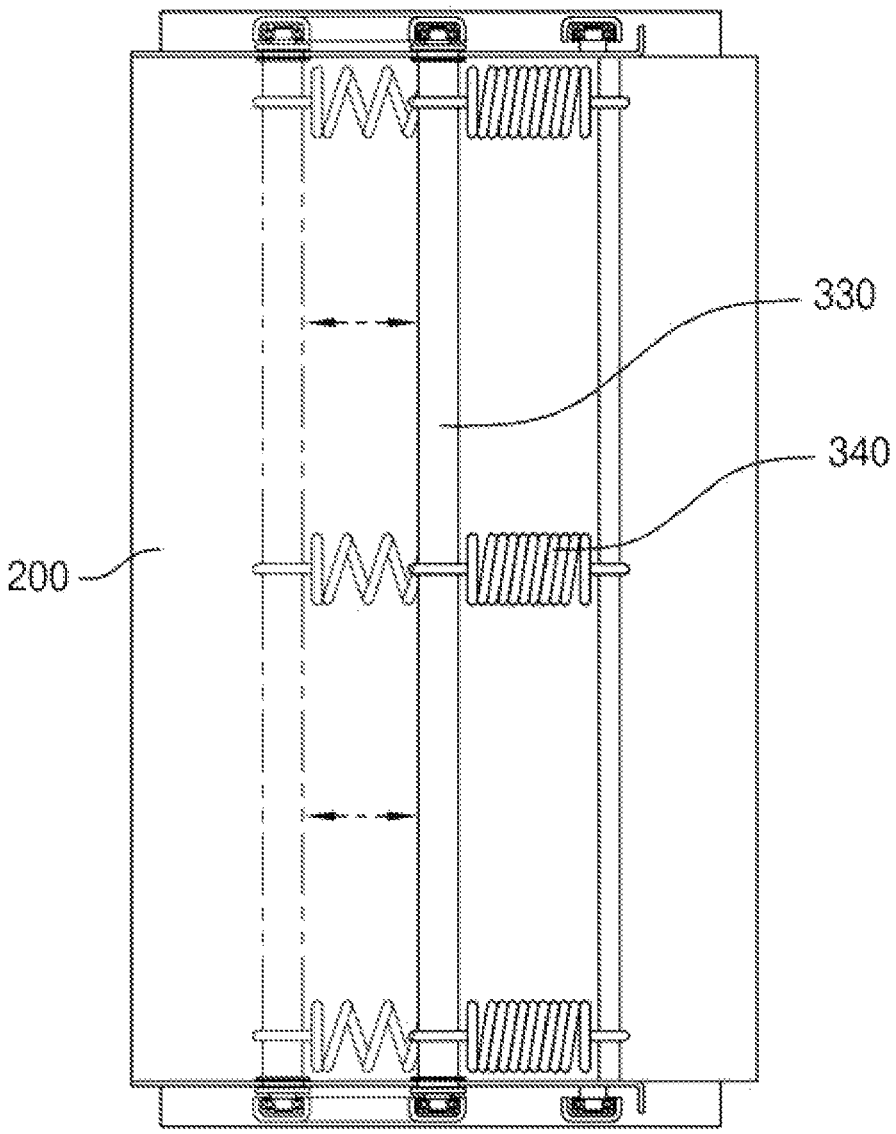
FIG. 4 is a bottom view illustrating a lower part of a work support of the load-adjustable vertically moving scaffold of FIG. 2.
Figure 5:
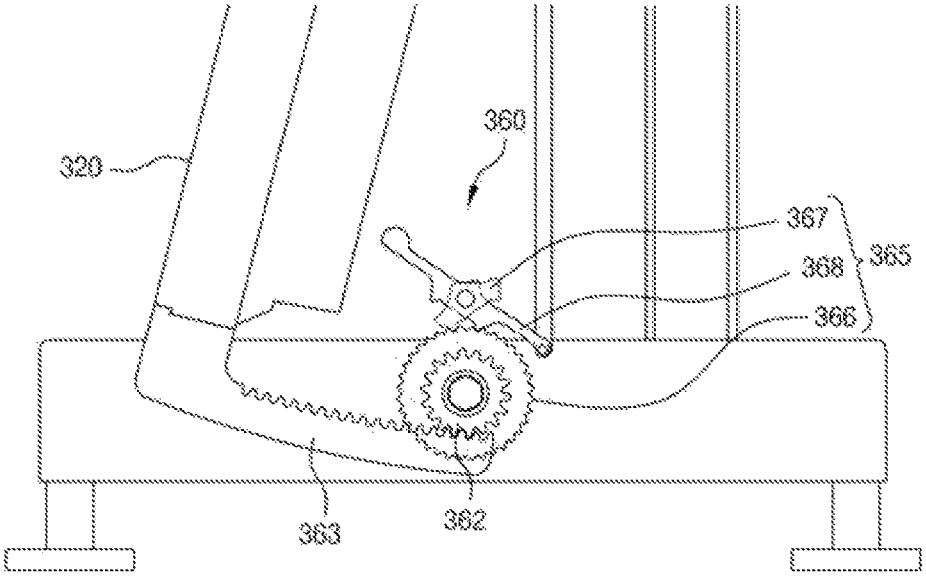
FIG. 5 is a view illustrating a tilt angle adjusting unit of the load-adjustable vertically moving scaffold of FIG. 2.

The first latch 367 and the second latch 368 control a setting direction by first and second latch operating units 369 and 370 shown in FIG. 2, respectively.

The tilt angle adjusting unit 360 of the embodiment of the present invention may allow a worker to arbitrarily select control of a lowering distance per unit weight according to the kinds or shapes of the objects to be processed to control the tilt angles of the slope guide members 320.

Further, the slope guide members 320 may be extended in parallel to the fixed guide members 310. In this case, when the slope guide members 320 are extended in parallel to the fixed guide members 310, the elastic member 340 is not elongated as the work support 200 is not lowered, and thus the work support 200 is lowered down to a lowermost position by a self-load of the work support 200 without external force.

When the objects to be processed should be loaded on the work support 200 while the objects to be processed are placed on a floor of the work place, the objects to be processed may be easily loaded on the work support 200 after the work support 200 is lowered by controlling the slope guide members to be extended in parallel to the fixed guide members 310. After the loading is completed, by controlling the slope guide members 320 to have desired tilt angles, the work support 200 is lifted by elastic force of the elastic member 340, and thus the worker may comfortably work while stretching his/her back.

Further, a sensor is attached to one side of the base unit 100 or the lift supporting unit 300 to sense the lowering of the work support 200, and the sensor may automatically check a daily workload by automatically monitoring the number of descents of the work support 200.

Figure 6:
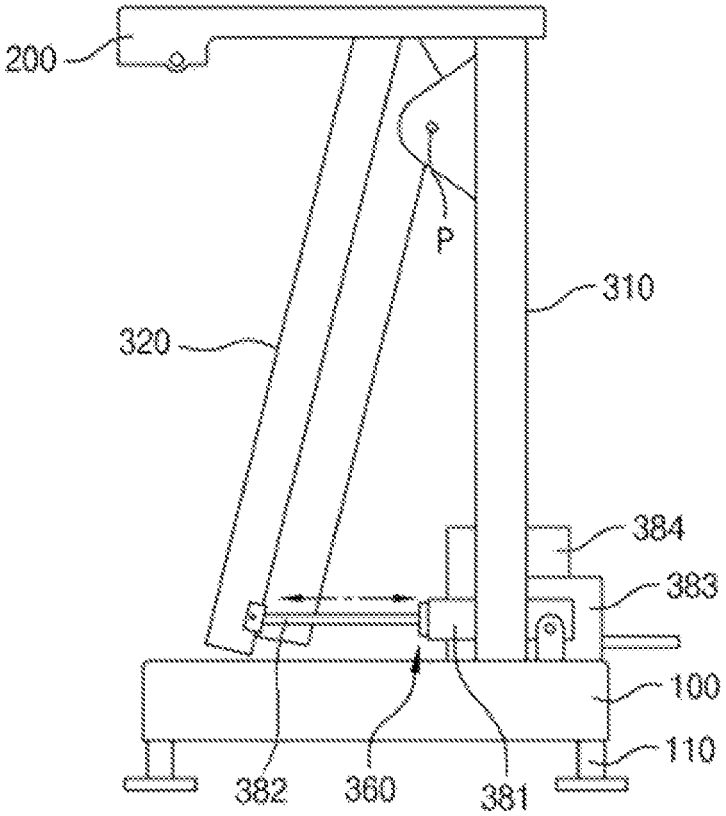
FIG. 6 is a view illustrating another embodiment of the tilt angle adjusting unit.

Another embodiment of the tilt angle adjusting unit 360 is illustrated in FIG. 6.

The tilt angle adjusting unit 360 of the embodiment of the present invention includes an actuator installed in the base unit 100, wherein the actuator may be applied with a pneumatic or hydraulic cylinder.

When a hydraulic cylinder is applied as the tilt angle adjusting unit 360 of the embodiment of the present invention, a cylinder main body 381 is fixed to the base unit 100, withdrawing rods 382 may be fixed to the slope guide members 320, and the slope guide members 320 may be adjusted while rotating forward and backward by forward and rearward movement of the withdrawing rods 382.

A pedal type hydraulic pump 383 and a hydraulic tank 384 are provided on one side of the base unit 100 to supply an oil pressure to the cylinder main body 381. Although not shown, a lever or button is provided at a position that the worker easily works to remove the oil pressure of the cylinder main body 381, and thus the oil pressure supplied to the cylinder main body 381 may be removed as necessary.

The actuator-type tilt angle adjusting unit of the embodiment of the present invention may also control a lowering distance per unit weight of the work support 200 by controlling the tilt angles of the slope guide members 320 based on the worker's own discretion.

Figure 7:
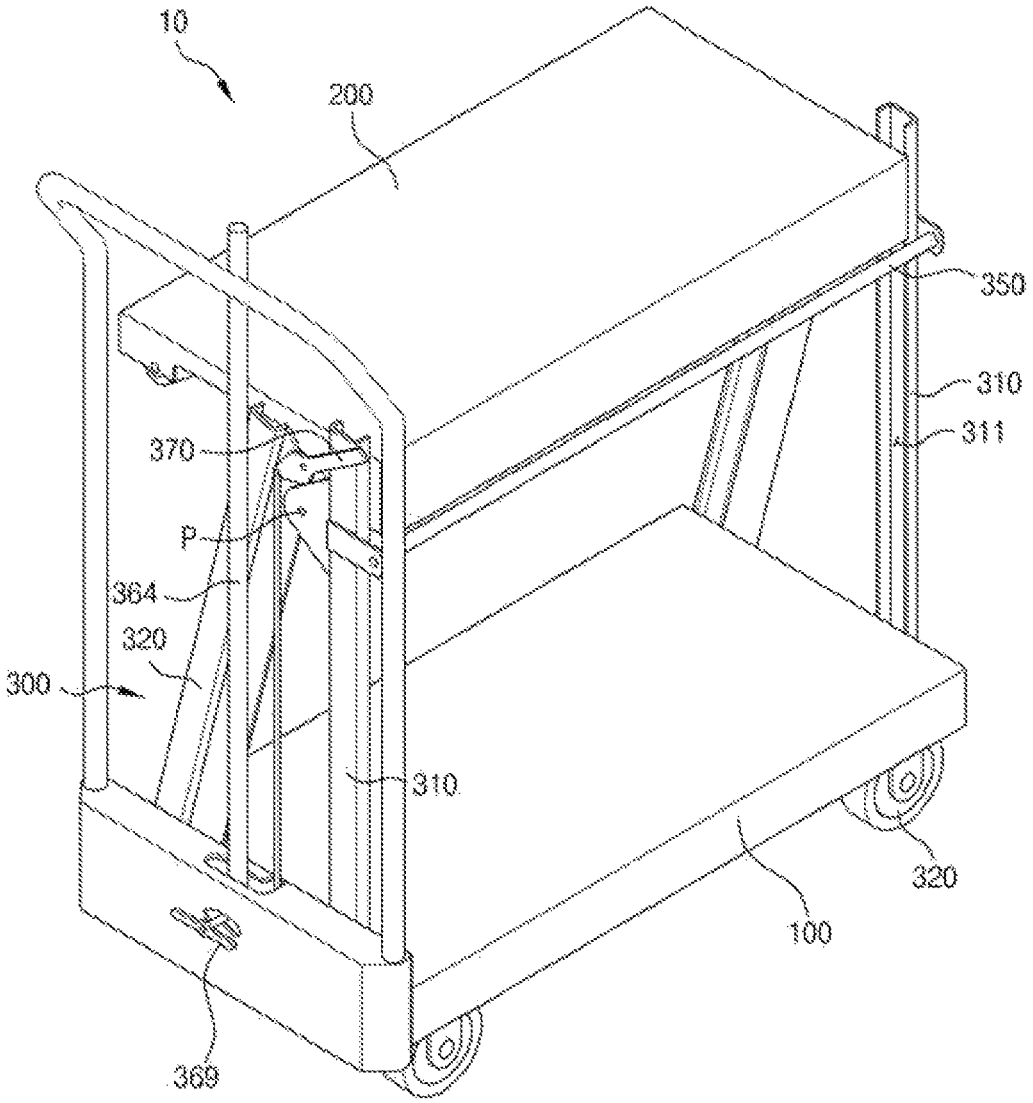
FIG. 7 is a view illustrating a state in which wheels are mounted to move the load-adjustable vertically moving scaffold of the present invention.

In the load-adjustable vertically moving scaffold 10 according to the present invention, as shown in FIG. 7, a transfer caster 320 is installed at a lower part of the base unit 100, so the base unit 100 is supported by the transfer caster 320. And thus, the worker may conveniently move the load-adjustable vertically moving scaffold 10, in this case, the load-adjustable vertically moving scaffold 10 can be widely used in the same form as a trolley.

Another embodiment of a load-adjustable vertically moving scaffold 20 according to the present invention is illustrated in FIGS. 8 to 13.

Referring to the figures, the load-adjustable vertically moving scaffold 20 includes a base unit 400, a work support 500 installed at an upper part of the base unit 400 to support objects to be processed, a lift supporting unit 600, and a cover unit 700 supporting the work support 500 to vertically move with respect to the base unit 400.

The base unit 400 is installed on a floor of the work place to support the lift supporting unit 600 and the work support 500. Like the embodiment of the present invention, the base unit 400 includes a supporting member 410 provided to be simply supported on the floor of the work place and to be fixed to and installed on the floor of the work place through an anchor, a fixing bolt, or the like.

The work support 500 is installed on the upper part of the base unit 400 to be vertically moved by the lift supporting unit 600, and is configured so that the objects to be processed are loaded or placed thereon for a work.

The work support 500 includes a lifting unit 520 lifted by the lift supporting unit 600 to be described below, a loading unit support 530 having one side fixed to the lifting unit 520 and extended toward the outside of the lifting unit 520 at a predetermined length, and a loading unit 540 coupled to the loading unit support 530.

The loading unit support 530 includes a connector 531 which has one end fixed to the lifting unit 520 and is exposed to the outside of the cover unit 700 to be described below through a long hole 710 of the cover unit 700, and a connecting plate 532 formed at an end part of the connector 531. The loading unit 540 is coupled to the connecting plate 532.

The loading unit 540 may load the objects to be processed and is connected with the lifting unit 520 through the loading unit support 530. Therefore, when the objects to be processed are loaded on the loading unit 540, a load is transferred to the lifting unit 520, and thus the loading position of the objects to be processed are vertically moved while the lifting unit 520 is lowered or lifted.

Figure 8:
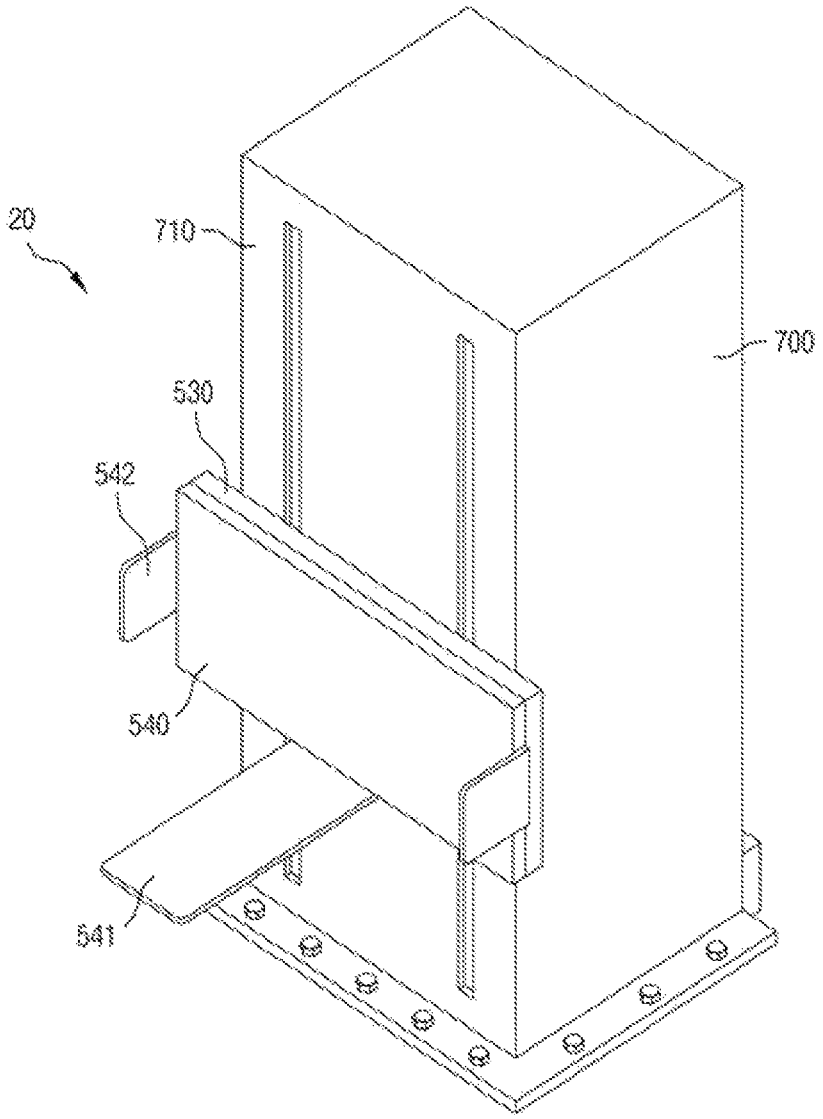
FIG. 8 is a perspective view illustrating another embodiment of the load-adjustable vertically moving scaffold according to the present invention.
Figure 9:
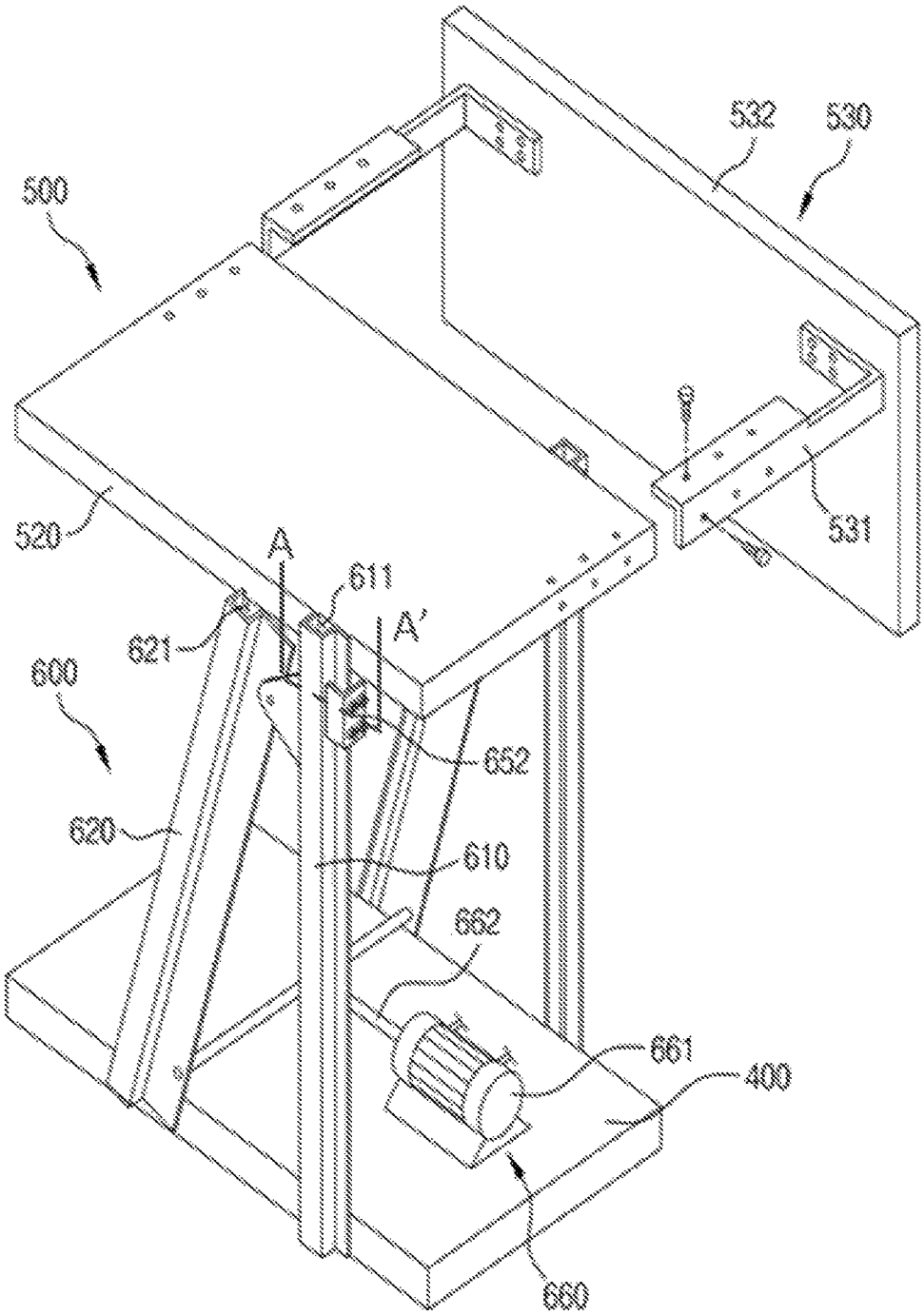
FIG. 9 is a perspective view illustrating an interior of the load-adjustable vertically moving scaffold of FIG. 8.
Figure 10:
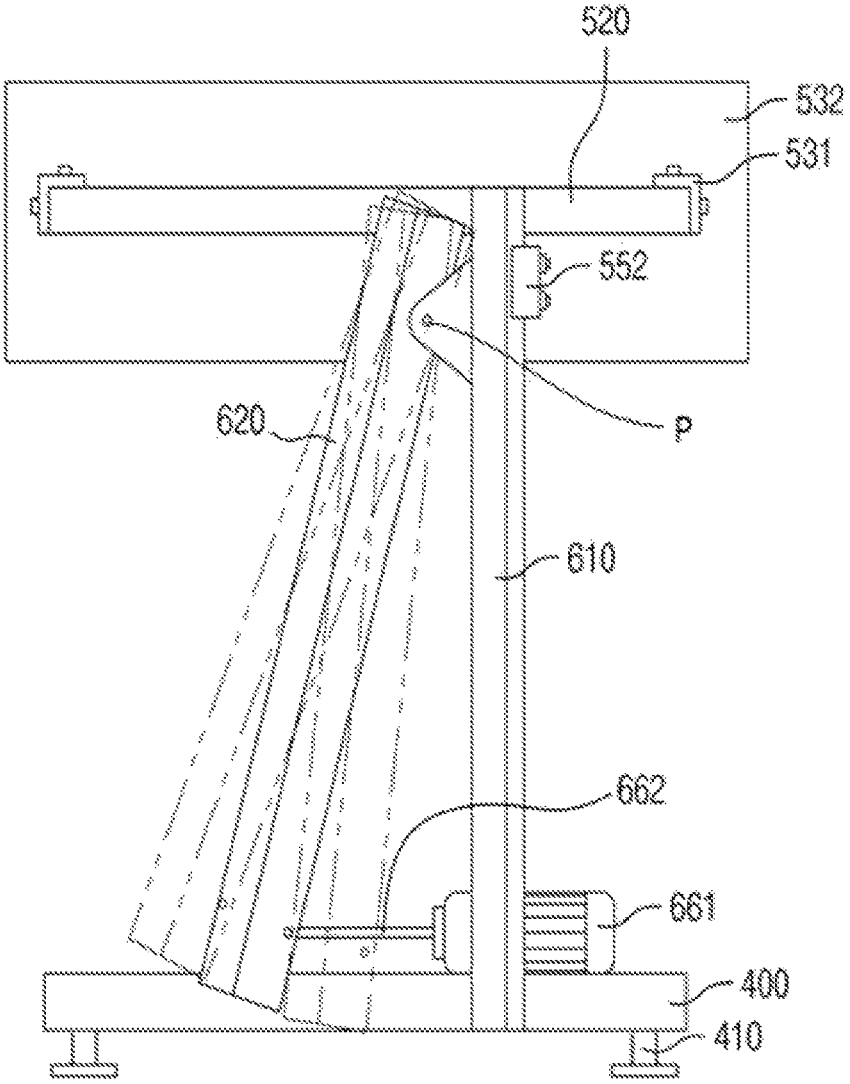
FIG. 10 is a rear view illustrating a rear surface of the load-adjustable vertically moving scaffold of FIG. 8.
Figure 11:
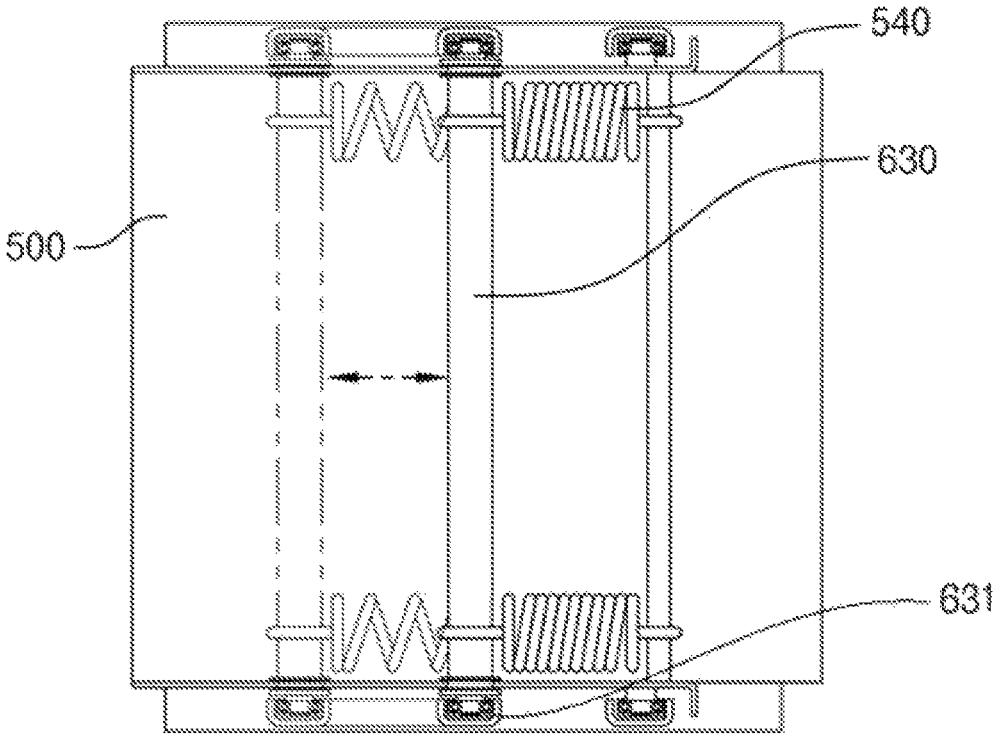
FIG. 11 is a bottom view illustrating a lower part of a lifting unit.
Figure 13:
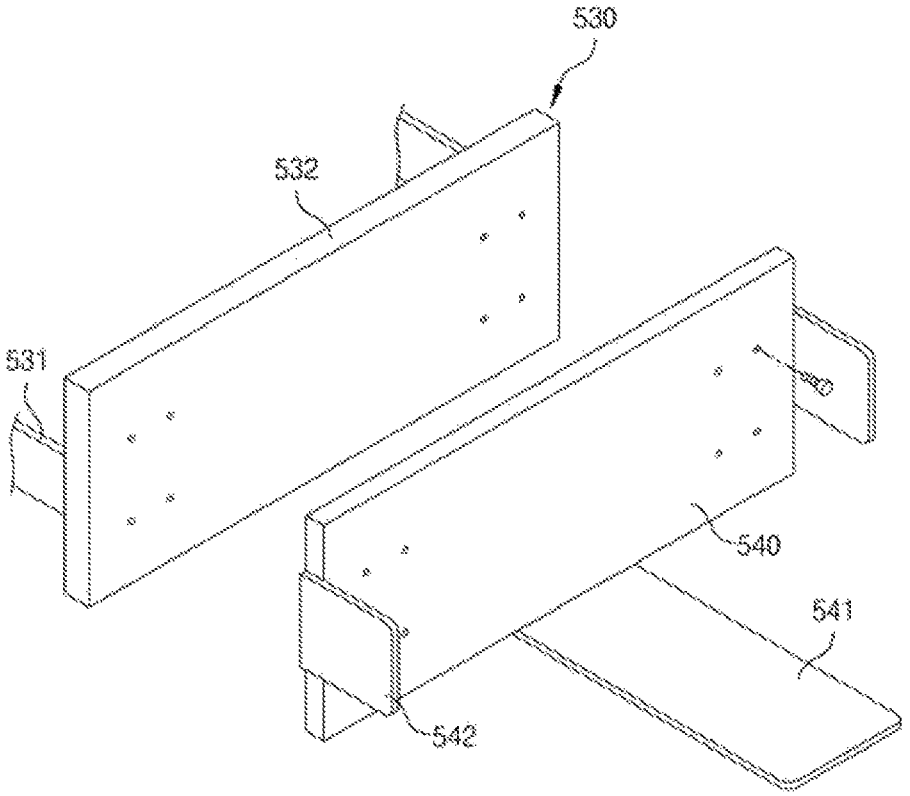
FIG. 13 is a perspective view illustrating an extracted loading unit.
Figure 14:
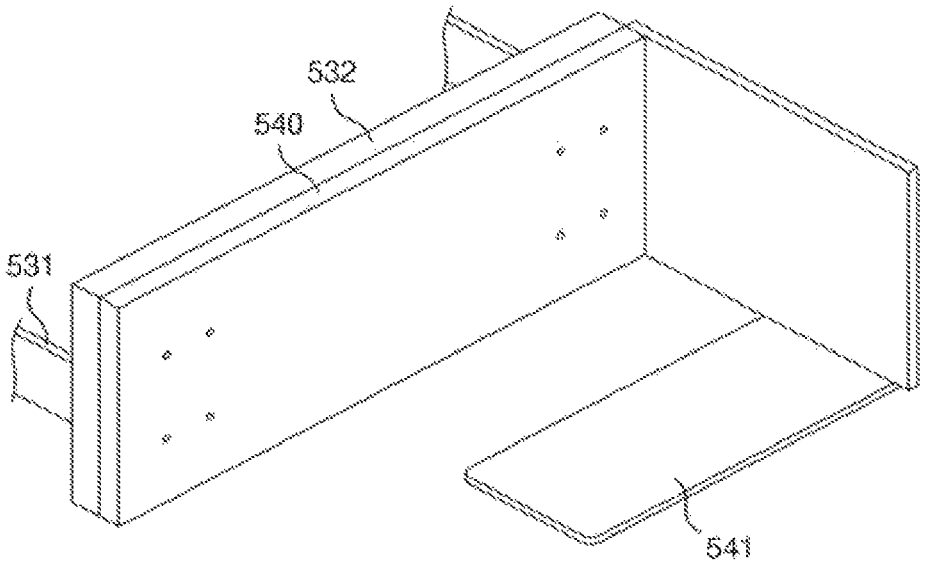
FIGS. 14 and 15 are perspective views of another embodiment of the loading unit.
Figure 15:
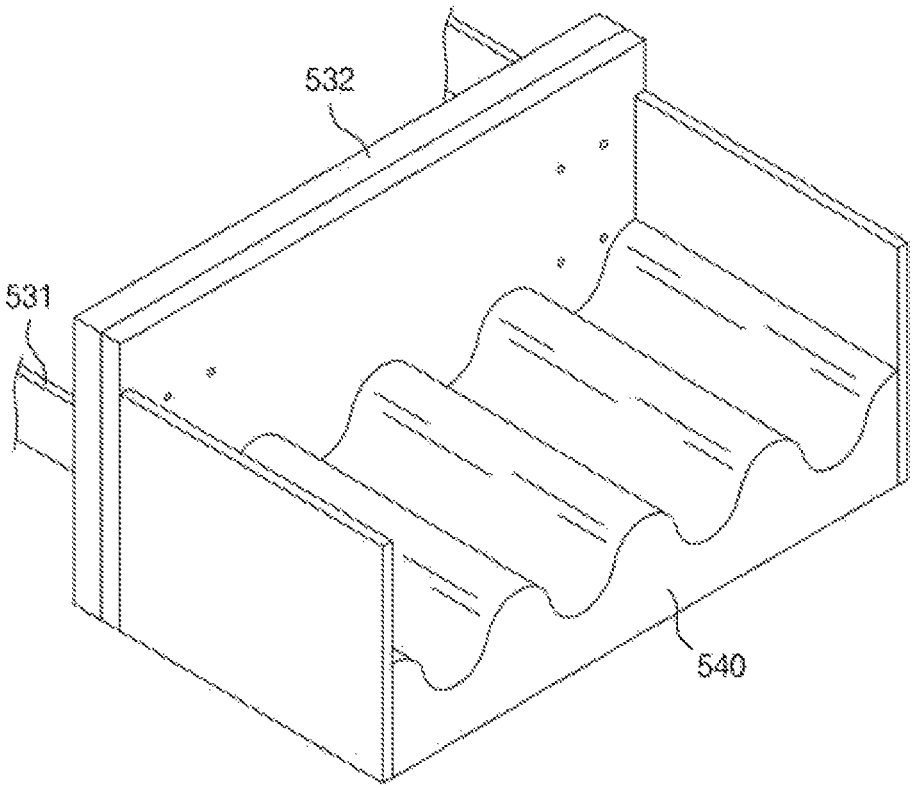

The loading unit 540, as shown in FIGS. 8 and 13, may be configured to support a box-shaped object to be loaded by including a support 541 formed at a lower part thereof and protrusion 542 formed at both edges thereof. Unlike this, as shown in FIG. 14, the support 541 may be extended in a lateral longitudinal direction. As shown in FIG. 15, the support 541 may be formed in a customized manner to correspond to shapes or sizes of the objects to be processed.

For example, when the objects to be processed are formed in cylindrical shapes, the cylindrical objects to be processed may not be loaded on the loading unit 540 that has a planar shape, and thus a semicircular groove may be formed on an upper surface of the loading unit 540.

Since the loading unit 540 of the embodiment of the present invention may be attached or detached to the loading unit support 530, the loading unit 540 may be manufactured in various shapes corresponding to the shapes of objects to be processed. The loading unit 540 having a shape appropriate to need is selected and is coupled to the loading unit support 530, thereby increasing work convenience.

The lift supporting unit 600 supports the work support 500 to vertically move with respect to the base unit 400.

The lift supporting unit 600 includes fixed guide members 610 extended upward from both sides of the base unit 400, slope guide members 620 spaced apart from the fixed guide members 610 at a predetermined distance, a lift supporting shaft 630 moving along with the slope guide members 620, and an elastic member 640 installed between the lift supporting shaft 630 and the work support 500.

Hereafter, for convenience, a portion to which the fixed guide members 610 are installed is referred to as a rear side of the base unit 400, and a direction in which the slope guide members 620 are installed with respect to the fixed guide members 610 is referred to as a front side.

The fixed guide members 610 are provided on both sides of a rear end part of the base unit 400, respectively, and are extended upward from the base unit 400 in a vertical direction. First guide grooves 611 extended in a vertical longitudinal direction are each formed on two opposite surfaces of the fixed guide members 610, and first guide rollers 510 installed on both sides of the rear side of the work support 500 are formed to move along the first guide grooves 611.

Figure 12:
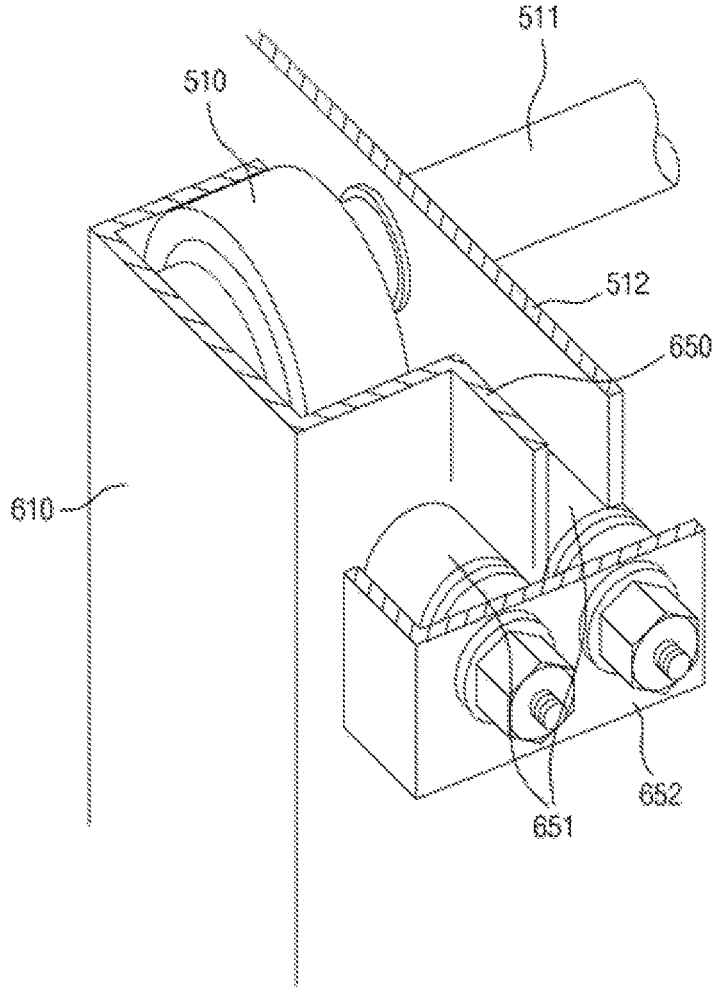
FIG. 12 is an enlarged partially cut-away perspective view illustrating a fixed guide member, and taken along line A-A' in FIG. 9.

As shown in FIG. 12, extension guide units 650 are extended from one side of each of the fixed guide members 610 at a predetermined length. Support bearings 651 are formed on both sides of the extension guide units 650 to move along the extension guide units 650. The support bearing 651 is coupled to a bearing support plate 652. The bearing support plate 652 is connected with an inner plate 512 on which a roller shaft 511 of the first guide rollers 510 moving along the first guide grooves 611 is supported. The support bearing 651 and the bearing support plate 652 are formed on the fixed guide members 610 and the extension guide units 650 to prevent the fixed guide members 610 from moving away from each other.

The slope guide members 620 are extended from front sides of the fixed guide members 610 to be tilted at a predetermined angle with respect to the fixed guide members 610. That is, the slope guide members 620 are formed to be tilted in a direction away from the fixed guide members 610 while being extended downward from upper ends. The slope guide members 620 each have one upper one side rotatably coupled to a connecting member formed in each of the fixed guide members 610, such that the slope guide members 620 may entirely be rotated at a predetermined angle with respect to a coupling point P.

Second guide grooves 621 are formed at opposite surfaces of the slope guide members 620 in a longitudinal direction, and the lift supporting shaft 630 is connected with the second guide grooves 621 to be lifted.

The lift supporting shaft 630 includes second guide rollers 631 formed on both sides thereof to move along the second guide grooves 621, so the lift supporting shaft 630 may vertically move along the slope guide members 620. The lift supporting shaft 630 supports a lower end of the work support 500.

The elastic member 640, which is an extension spring, has one end connected to a rear end of the work support 500 or a roller shaft 511 and the other end connected to the lift supporting shaft 630.

Further, a gas cylinder is further provided at a lower part of the work support 500 to absorb shock. One side and the other side of the gas cylinder are each installed at the lift supporting shaft 630 and the front end of the work support 500 to prevent the work support 500 from being suddenly lowered or lifted due to sudden change in a load generated when the objects to be processed are suddenly loaded on or unloaded from the work support 500.

In the lift supporting unit 600, the slope guide members 620 are formed to be tilted in a direction away from the fixed guide members 610 while being extended downward from the fixed guide members 610. Thus, when the objects to be processed are loaded on the work support 500, the work support 500 is lowered while the elastic member 640 is elongated by the load of the objects to be processed. The work support 500 is stopped at a point that the load of the objects to be processed on the work support 500 and elastic force of the elastic member 640 are in equilibrium. When objects to be processed are additionally loaded, the work support 500 is further lowered to correspond to an increased load. Conversely, when the objects to be processed loaded on the work support 500 are unloaded, the work support 500 is lifted by the elastic force of the elastic member 640 while the load is reduced.

Since the work support 500 is automatically lowered or lifted depending on whether the load, applied to the work support 500 while the objects to be processed are loaded on or unloaded from the work support 500, is changed, a worker may continue to work a predetermined height, thereby increasing work efficiency.

Also, the lift supporting unit 600 may further include a tilt angle adjusting unit 660 to control tilt angles of the slope guide members 620.

As the tilt angles of the slope guide members 620 are adjusted by the tilt angle adjusting unit 660, when the objects to be processed are loaded or unloaded, a lift distance per unit weight of the work support 500 may be adjusted. That is, when the slope guide members 620 have larger tilt angles than the fixed guide members 610, a lowering distance per unit weight of the work support 500 is reduced. Conversely, when other slope guide members 620 are moved in a direction approaching the fixed guide members 610, such that the tilt angles are reduced, the lowering distance per unit weight of the work support 500 is increased.

Therefore, when the objects to be processed are made of a material having a high specific gravity such as metal or stone, tilt angles of the slope guide members 620 are increased. When the objects to be processed are made of a material having a low specific gravity such as a synthetic resin, a fiber, or a paper box, the tilt angles of the slope guide members 620 are reduced. Thus, a lowering distance is controlled according to kinds of the objects to be processed.

The tilt angle adjusting unit 660 may be applied with an actuator installed in the base unit 400.

In the case of the embodiment of the present invention, the tilt angle adjusting unit 660 is applied with the hydraulic cylinder. A cylinder main body 661 is installed in the base unit 400, and a cylinder rod 662 is connected with the slope guide members 620. And thus, the slope guide members 620 are rotated forward and backward through forward and rearward movement.

Although not shown, a fluid tank for supplying fluid and a hydraulic pump for supplying the fluid to a cylinder may be provided at the base unit 400 or a position adjacent thereto. The hydraulic pump may be formed in a pedal or lever type, and may include a separate switch for removing an oil pressure.

Also, not shown, an electric actuator may be applied as an actuator applied to the tilt angle adjusting unit 660. When power is supplied, a motor is operated, and thus withdrawing rods are moved forward and backward to rotate the slope guide members 620.

The tilt angle adjusting unit 660 of the embodiment of the present invention may allow a worker to arbitrarily select control of a lowering distance per unit weight according to the kinds or shapes of the objects to be processed to control the tilt angle of the slope guide members 620.

Further, the slope guide members 620 may be extended in parallel to the fixed guide members 610. In this case, when the slope guide members 620 are extended in parallel to the fixed guide members 610, the elastic member 640 is not elongated as the work support 500 is not lowered, so the work support 500 is lowered down to a lowermost position by a self-load of the work support 500 without external force.

When the objects to be processed are loaded on the work support 500 while the objects to be processed are place on a floor of the work place, the objects to be processed may be easily loaded on the work support 500 after the work support 500 is lowered by controlling the slope guide members 620 to be extended in parallel to the fixed guide members 610. After the loading is completed, by controlling the slope guide members 620 to have desired tilt angles, the work support 500 is lifted by elastic force of the elastic member 640, and thus the worker may comfortably work while stretching his/her back.

Further, a sensor is attached to one side of the base unit 400 or the lift supporting unit 600 to sense the lowering of the work support 500, and the sensor may automatically check a daily workload by automatically monitoring the number of descents of the work support 500.

The cover unit 700 may be formed in a hexahedral shape surrounding the base unit 400, the lift supporting unit 600, and the lifting unit 520. The long hole 710 is formed on one side of the cover unit 700 to be vertically extended, so the loading unit support 530 passes through the long hole 710.

The loading unit support 530 may be vertically moved along the long hole 710 at a time of lifting of the lifting unit 520.

The load-adjustable vertically moving scaffold according to the present invention described above maintains loading positions of the objects to be processed to a predetermined position by vertically moving the loading unit when the objects to be processed are loaded or unloaded, thereby improving waist health and work efficiency of the worker. Particularly, since the movement distance per unit weight of the loading unit 240 is arbitrarily selected by the worker, the load-adjustable vertically moving scaffold may be applied to various objects to be processed having a small specific gravity.

Descriptions of the described embodiments of the present invention will be provided so that those skilled in the art may use and practice the present invention. It will be clear to those skilled in the art that various modifications and improvements within the scope of the invention may be made. The general principles defined herein may be applied to other embodiments without departing from the gist of the invention. Thus, the present invention is not intended to be limited to the embodiments shown but is to be translated within the widest scope consistent with the principles and noble features described herein.

The load-adjustable vertically moving scaffold of the present invention may be used in various fields of industry, such as a manufacturing industry.

What is claimed is:

1. A load-adjustable vertically moving scaffold, comprising:

a base unit;

a work support provided on an upper part of the base unit and configured to support objects to be processed; and a lift supporting unit supporting the work support to vertically move with respect to the base unit, wherein the lift supporting unit comprises fixed guide members extended upward from both sides of the base unit, slope guide members installed at front sides of the fixed guide members and configured to be tilted with respect to the fixed guide members in a direction away from the fixed guide members while being extended downward from an upper end thereof, a lift supporting shaft configured to vertically move along the slope guide members, and an elastic member having one end fixed to one side of the work support adjacent to the fixed guide members and other end connected with the lift supporting shaft to apply an elastic bias to the lift supporting shaft toward the fixed guide members, wherein the work support is coupled so that the one side to which the elastic member is fixed is vertically moved along the fixed guide members, and has a lower end of other side formed to be supported on the lift supporting shaft.

2. The load-adjustable vertically moving scaffold of claim 1, wherein the slope guide members are each coupled to one side of each of the fixed guide members to be rotatable in forward and rearward directions of the base unit so that tilt angles are adjustable with respect to the fixed guide members, and further comprise a tilt angle adjusting unit to control the tilt angles of the slope guide members.

3. The load-adjustable vertically moving scaffold of claim 2, the slope guide members are extended in parallel to the fixed guide members to be lowered down to a lowermost position even if the objects to be processed are not loaded on the work support.

4. The load-adjustable vertically moving scaffold of claim 2, wherein the tilt angle adjusting unit comprises:

a rotating shaft extended in a direction in which both slope guide members are connected to the base unit and rotatably installed thereto;

pinions coupled to both ends of the rotating shaft and integrally rotating with the rotating shaft;

racks formed on lower ends of the slope guide members, extended in a circular arc direction with respect to rotation centers of the slope guide members, and engaged with the pinions; and a control lever controlling the tilt angles of the slope guide members by rotating the slope guide members, which are connected through the racks, by rotating the pinions.

5. The load-adjustable vertically moving scaffold of claim 4, wherein the tilt angle adjusting unit further comprises a latching unit connecting the rotating shaft and the control lever so that the pinions are rotated in one direction by the rotation of the control lever in a process in which the tilt angles of the slope guide members are controlled by the control lever.

6. The load-adjustable vertically moving scaffold of claim 2, the tilt angle adjusting unit comprises an actuator including a main body installed at the base unit and withdrawing rods connected with the slope guide members, and is configured to control the tilt angles of the slope guide members by forward and backward movement of the withdrawing rods.

7. The load-adjustable vertically moving scaffold of claim 1, wherein the base unit further comprises a transfer caster formed on a lower part thereof to be movable.

8. The load-adjustable vertically moving scaffold of claim 1, wherein the work support further comprises:

a lifting unit supported to be lifted with respect to the base unit by the lift supporting unit; and a loading unit support which protrudes forward from the lifting unit to be lifted along with the lifting unit and is coupled to the loading unit.

9. The load-adjustable vertically moving scaffold of claim 8, wherein the work support further comprises a cover unit configured to surround the base unit, the lift supporting unit, and the lifting unit, and having a hole vertically extended on one side thereof so that the loading unit support passes therethrough.

10. The load-adjustable vertically moving scaffold of claim 8, wherein the loading unit is configured to correspond to shapes or sizes of the objects to be processed and is configured to be coupled to and separated from the loading unit support.

* * * * *